United States Patent [19]

Balsley

[11] Patent Number: 4,964,508

[45] Date of Patent: Oct. 23, 1990

[54] KEY CACHE

[76] Inventor: Joseph W. Balsley, P.O. Box 2014, Rancho Santa Fe, Calif. 92067

[21] Appl. No.: 427,237

[22] Filed: Oct. 25, 1989

Related U.S. Application Data

[63] Continuation of Ser. No. 296,959, Jan. 17, 1989, abandoned.

[51] Int. Cl.[5] ..... A45C 11/32

[52] U.S. Cl. ..... 206/37.1; 206/38.1; 150/143; 150/147; 224/901

[58] Field of Search ..... 206/37.1, 37.3, 37.4, 206/39.4, 39, 39.1, 38.1; 150/134, 143, 147, 149; 224/901

[56] References Cited

U.S. PATENT DOCUMENTS

| | | | |
|---|---|---|---|
| 778,053 | 12/1904 | Lindsley | 150/149 |
| 1,519,148 | 12/1924 | Lakin | 150/134 X |
| 2,172,883 | 9/1939 | Wege | 206/38.1 |
| 3,144,935 | 8/1964 | Geyler | 206/37.1 X |
| 3,415,300 | 12/1968 | Worcester | 206/38.1 |
| 3,563,293 | 2/1971 | Fisher | 206/37.1 |
| 3,895,797 | 7/1975 | Moore | 224/901 X |
| 4,079,767 | 3/1978 | Howard | 224/901 X |
| 4,083,321 | 4/1978 | LeBron et al. | 150/134 X |
| 4,139,133 | 2/1979 | Repka | 224/901 |
| 4,332,338 | 6/1982 | Christiansen | 150/143 X |
| 4,341,331 | 7/1982 | McDougall | 224/901 X |
| 4,498,615 | 2/1985 | Johnson | 224/901 X |
| 4,570,688 | 2/1986 | Williams | 150/134 |
| 4,625,862 | 12/1986 | Clayton | 224/901 X |
| 4,705,086 | 11/1987 | O'Neill | 206/37.1 X |
| 4,779,655 | 10/1988 | Olson | 150/134 |

*Primary Examiner*—William I. Price

*Attorney, Agent, or Firm*—Brown, Martin, Haller & McClain

[57] ABSTRACT

A cache or holder for a key or other small item comprises a first part having at least one pocket for holding a key and a second part releasably securable to the first part and having an adhesive layer or other securing device for securing the second part to a selected surface in a concealed location.

4 Claims, 1 Drawing Sheet

KEY CACHE

This is a continuation of application Ser. No. 296,959 filed Jan. 17, 1989 now abandoned.

BACKGROUND OF THE INVENTION

The present invention relates generally to a cache or holder for keys or other relatively small items for holding them in an accessible, hidden location for use when needed, for example for caching a spare house or car key for use if a person loses their keys or locks them in a house or car, or for hiding items of value when traveling or at work, for example.

Key caches or holders are known which incorporate a magnet for attaching the holder to a suitable metallic surface, for example inside the hood of a car. However, these have the disadvantage that they can only be attached to certain metallic surfaces, and if the surface is soiled the holder may not attach at all or may only attach loosely. When such holders are attached to a car surface, they may be dislodged and lost during driving, particularly if the car is driven over an uneven surface. Thus, key caches which are attached via a magnet have the disadvantage that a location which is both hidden and has an attachment surface of suitable magnetic material must be found for the cache, which may be difficult when hiding a spare house key, for example.

SUMMARY OF THE INVENTION

It is an object of the present invention to provide an improved holder or cache for keys or the like.

According to the present invention, a key holder is provided which comprises a first part having at least one pocket for holding a key or other item, and a second part having a fastener or securing device for securing it to any relatively smooth surface. Releasable fasteners are provided on the first and second parts for releasably securing them together. Thus, with this arrangement, the second part of the holder may be more or less permanently attached to a selected surface while the first part is releasably secured to the second part to hold the key or other item in a hidden location until needed.

The holder does not rely on magnets and can be adhered to any smooth surface of any material, including metal, wood, rubber, fiberglass and plastic. Once secured, the holder will be unlikely to jar loose.

In the preferred embodiment of the invention, the second part of the holder comprises a flat band or strip having adhesive on one face for adhesively securing it to a selected surface, which may be of any material such as wood, plaster, metal and so on. A suitable fastener is provided on the opposite face of the strip for releasably securing it to the other part of the holder. In the preferred embodiment, interengageable strips of hook and loop type fastener material such as Velcro (Registered Trade Mark) are applied to the engaging faces of the two parts of the holder.

Preferably, the first part of the holder comprises a wallet or folder-like member having two panels secured together along a fold line, with a pocket in the inner face of at least one of the panels. Inner pockets may be provided in both panels for hiding additional items, such as emergency money or credit cards. A flap or other closure is provided for releasably closing the pocket opening, and the two panels may be releasably secured together when closed for additional security. With this arrangement the key or item will be held very securely and will be unlikely to be dislodged from the pocket accidentally. Also, the holder itself can be securely attached to any selected surface, even where the surface is dirty as is often the case on concealed surfaces of vehicles.

BRIEF DESCRIPTION OF THE DRAWINGS

The above will be better understood from the following detailed description of a preferred embodiment of the invention, taken in conjunction with the accompanying drawings, in which like reference numerals refer to like parts and in which.

DESCRIPTION OF THE PREFERRED EMBODIMENT

The drawings illustrate a key cache or holder !0 according to a preferred embodiment of the present invention. The cache is in two parts, a first part 12 for holding a key or other item, and a second part 14 for securing the holder in a suitable surface in a selected hiding place.

Figure 4:
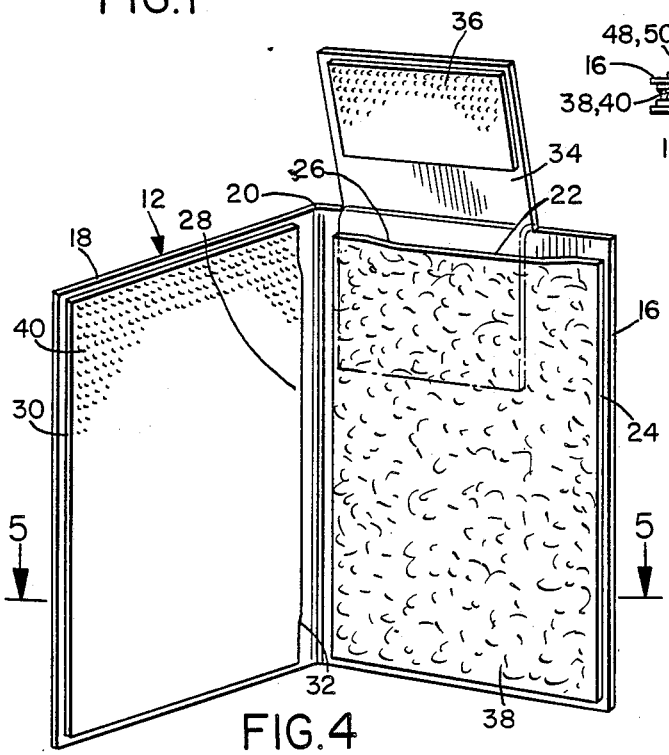
FIG. 4 is a perspective view of the key holder in an open position.
Figure 5:
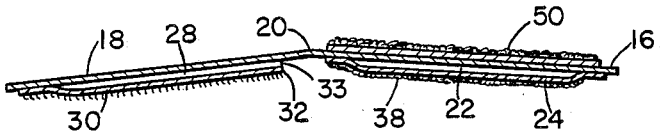
FIG. 5 is a cross-section on the lines 5—5 of FIG. 4.

The first part 12 of the holder basically comprises a wallet or folder-like member having two panels 16,18 secured together along a fold line 20. The member 12 may be of any suitable material such as fabric, plastic or leather. As best illustrated in FIGS. 4 and 5, a first pocket 22 is formed on the inner face of one of the panels by securing an additional layer 24 of material along three sides to the inner face of the panel, for example by stitching or adhesive, leaving an opening 26 at one end of the pocket. The pocket is preferably rectangular in shape with the opening being provided along one of the shorter sides of the rectangle. The dimensions of the pocket are selected to allow standard size keys to be deposited in the pocket, although other small items may be stored in the pocket if desired.

A second pocket 28 is preferably formed on the inner face of the other panel by securing a layer 30 of material along three edges to the panel, with the innermost edge 32 adjacent the fold line unattached to provide an opening 33 (see FIG. 5) for deposit of items in the pocket.

Figure 1:
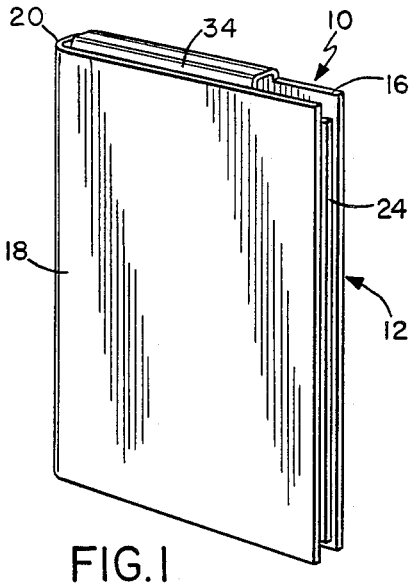
FIG. 1 is a perspective view of a key holder or case according to a preferred embodiment of the present invention.
Figure 2:
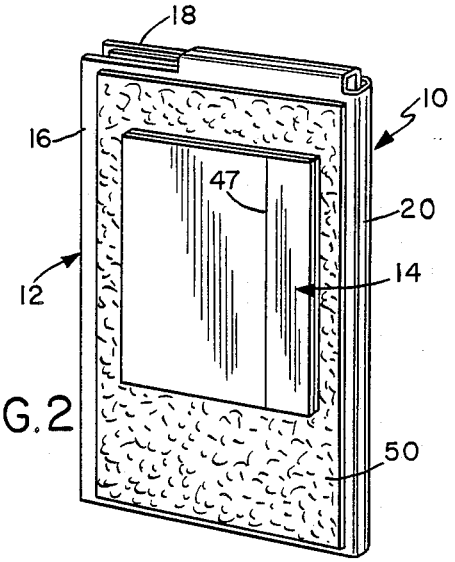
FIG. 2 is a perspective view showing the rear of the key holder.
Figure 3:
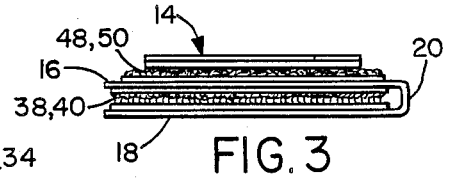
FIG. 3 is a bottom plan view of the holder.

A releasable closure flap 34 for closing the opening in the first pocket 22 projects from the edge of the panel adjacent the opening. Suitable interengageable fasteners 36,38 are applied to the opposing inner face of the flap 34 and outer face of the pocket 22. Preferably, fasteners 40 are also provided on the outer face of pocket 28 so that the pockets can be secured together to close wallet member 14 as illustrated in FIGS. 1 to 3. Thus a two stage closure for pocket 22 is provided, considerably reducing the risk of any item in pocket 22 being dislodged. Any suitable fasteners may be provided on the opposing faces of flap 34, pocket 22 and pocket 28. However, in the preferred embodiment of the invention, the fasteners comprise co-operating strips of hook and loop type fastener material, of the type known as Velcro (Registered Trade Mark). A strip of this material is applied to the inner face of flap 34, while a co-operating strip or layer of corresponding interengaging fastener material may be secured to the outer face of pocket 22, and a layer for co-operating with the outer face of pocket 22 may be applied to pocket 28. However, preferably, the outer layers 24, 30 of pockets 22, 28, respectively, are themselves formed of Velcro material with the fastener surface facing outwardly, as illustrated in FIGS. 3 to 5. Thus, a strip of hook material may be applied to flap 34, and the outer layer of pocket 28 may also be of hook material, while the outer layer of pocket 22 is of loop material, or vice versa.

Figure 6:
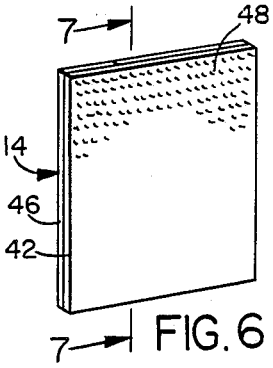
FIG. 6 is a perspective view of a part of the key holder designed for attachment to a smooth surface.
Figure 7:
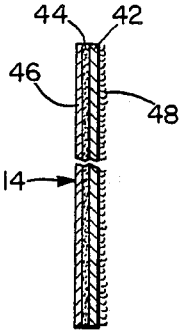
FIG. 7 is a cross section on the lines 7—7 of FIG. 6.

The second part 14 of the holder is best illustrated in FIGS. 6 and 7 and comprises a flat strip like layer 42 having an adhesive layer or coating 44 on one face which is covered by a suitable removable cover layer 46 of paper or the like. A score line 47 may be provided across layer 46 to aid in removal of this layer. Suitable fasteners 48, 50 are provided on the opposite face of member 42 and on outer face of first part 12 for releasably securing the two parts of the holder together, as indicated in FIGS. 2 and 3. Any suitable fastener devices may be used, but in the preferred embodiment of the invention illustrated in the drawings, layer 42 is of fastener material with its fastener surface 48 facing outwardly and fastener 50 comprises a cooperating layer of similar fastener material such as hook and loop type material is secured to the outer face of one of the panels. The fastener material is preferably Velcro (Registered Trade Mark).

With this arrangement, when a person wishes to hide an item of value such as a key for emergency use, for example for use if they are locked out of a car or house, they first deposit the key in pocket 22 and close it via flap 34. The opposing faces of the panels are also secured together on closing the wallet for additional security. If desired, other items such as emergency cash or a credit card may be hidden in separate pocket 28, with the opening into the pocket being securely closed when the opposing faces of the panel are secured together. A suitable hiding place is then selected, the cover layer 46 is removed from member 42 and the member is stuck to a suitable smooth surface via adhesive layer 44. The adhesive material used will be a multi-purpose adhesive suitable for securely fastening the holder to many different types of surface including wood, metal, plastic, fiberglass, rubber, and so on. If necessary, dependent on the type of adhesive used, the bond between part 14 and the surface may be strengthened by leaving it for a predetermined interval before attaching or removing the first part of the key holder. In a preferred embodiment, the adhesive layer was of 3M acrylic adhesive tape A-25-Y-9485 PC. In the event that the key is needed, the first part of the holder is easily detached from the second part, allowing the key to be removed.

The cache or holder of this invention can be securely attached to any selected surface, not just certain metallic surfaces, considerably increasing the number of possible hiding places. It will be less likely to be dislodged when secured to a vehicle surface while the vehicle is driven over rough terrain or bumpy roads. It may be used for hiding spare house keys as well as car keys, considerably reducing the inconvenience of locking oneself out of a house or car or of losing one's keys. It may also be used for hiding other items of value, for example for hiding items in hotel rooms, and for hiding emergency cash, credit cards or the like when traveling or when at work, where it may be secured to interior concealed surfaces of cupboards, desks or the like, for example, where it would be unlikely to be found by intruders.

Although a preferred embodiment of the invention has been described above by way of example only, it will be understood by those skilled in the field that modifications may be made to the disclosed embodiment without departing from the scope of the invention, which is defined by the appended claims.

I claim:

1. A holder for a key or other item, comprising:

a first part comprising a wallet-like member having first and second panels secured together along a fold line, at least one pocket for holding a key being located on the inner face of one of said panels and having an opening for deposit and removal of items from said pocket, a releasable closure device for releasably closing said opening, and interengageable fastener means on the inner faces of said panels for releasably securing the panels together in a closed condition;

a second part comprising a flat, panel-like member having an adhesive layer on one of its faces comprising means for securing said second part to a flat surface;

interengageable fastener means on an outer face of said first part and on the opposite face of said second part to said adhesive layer for releasably securing said parts together; and said releasable closure device comprising a pliable flap projecting from an edge of said first panel adjacent said opening and having fastener means on its inner surface identical to the fastener means on the inner surface of said second panel for releasably securing said flap to the inner surface of said first panel to close said opening.

2. The holder as claimed in claim 1, wherein said interengageable fastener means on said first and second parts comprise interengaging strips of hook and loop type fastener material.

3. The holder as claimed in claim 1, wherein said fastener means on the inner surfaces of said panels comprise opposing strips of hook and loop type fastener material.

4. The holder as claimed in claim 1, wherein a second pocket is located on the inner face of the other panel.

* * * * *